US006883482B2

(12) United States Patent
Takenaka et al.

(10) Patent No.: US 6,883,482 B2
(45) Date of Patent: Apr. 26, 2005

(54) VARIABLE VALVE TIMING CONTROLLER

(75) Inventors: Akihiko Takenaka, Anjo (JP); Takayuki Inohara, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/901,323

(22) Filed: Jul. 29, 2004

(65) Prior Publication Data

US 2005/0022765 A1 Feb. 3, 2005

(30) Foreign Application Priority Data

Jul. 30, 2003 (JP) ..... 2003-283016

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS 6,502,537 B1 * 1/2003 Todo et al. ..... 123/90.17

6,684,837 B1 * 2/2004 Miyakoshi ..... 123/90.17

FOREIGN PATENT DOCUMENTS

| | | |
|---|---|---|
| JP | A-2001-41013 | 2/2001 |
| JP | A-2002-227616 | 8/2002 |

* cited by examiner

*Primary Examiner*—Thomas Denion
*Assistant Examiner*—Zelalem Eshete
(74) *Attorney, Agent, or Firm*—Nixon & Vanderhye P.C.

(57) ABSTRACT

The variable valve timing controller controls the valve timing of the intake valve. The variable valve timing controller has a phase adjusting mechanism which includes a first rotating member, a second rotating member, a first arm, and a second arm. The first rotating member rotates in synchronism with a driving shaft and the second rotating member rotates in synchronism with a driven shaft. The first arm is pivoted on the first rotating member and the second arm is pivoted on the second rotating member and the first arm. The phase adjusting mechanism varies the rotational phase of the driven shaft relative to the driving shaft with converting the a movement of the first arm and the second arm into the rotational movement of the first rotating member and the second rotating member.

10 Claims, 18 Drawing Sheets

VARIABLE VALVE TIMING CONTROLLER

CROSS REFERENCE TO RELATED APPLICATION

This application is based on Japanese Patent Application No. 2003-283016 filed on Jul. 30, 2003, the disclosure of which is incorporated herein by reference.

FIELD OF THE INVENTION

The present invention relates to a variable valve timing controller which changes opening and timing of intake valves and/or exhaust valves of an internal combustion engine according to operating condition of the engine. The opening and closing timing is referred to as valve timing, the variable valve timing controller is referred to as the VVT controller, and the internal combustion engine is referred to as an engine hereinafter.

BACKGROUND OF THE INVENTION

The VVT controller is disposed in a torque transfer system which transfers the torque of the driving shaft of the engine to the driven shaft which opens and closes at least one of an intake valve or an exhaust valve. The VVT controller adjusts the valve timing of the valves by varying a rotational phase of the driven shaft to the driving shaft.

JP-2002-227616A shows a VVT controller having a sprocket which rotates in synchronism with the driving shaft, and a rotational phase adjusting mechanism which connects levers with the driven shaft via link arms. The phase adjusting mechanism converts a movement of the link arms into a relative rotational movement of the levers to the sprocket and varies the rotational phase of the driven shaft relative to the drive shaft.

In this conventional controller, guide balls held by the operation member are slidably engaged with a groove of the sprocket. When an engine torque is varied and some force are applied to the phase adjusting mechanism, the operation member may slide in the groove so that the rotational phase of the driven shaft unnecessarily varies relative to the driving shaft.

SUMMARY OF THE INVENTION

The present invention is made in view of the above matters, and it is an object of the present invention to provide the VVT controller which restricts rotational-phase fluctuations of the driven shaft if the force is applied to the phase adjusting mechanism.

According to the present invention, the phase adjusting mechanism includes a first rotational member rotating in synchronism with the driving shaft, a second rotational member rotating in synchronism with the driven shaft, a first arm rotationally connected with the first rotational member, and a second arm rotationally connected with the second rotational member and the first arm. That is, all parts of the phase adjusting mechanism are rotatively connected with each other. Thus, even if some force due to the engine torque fluctuation are applied to the phase adjusting mechanism, one of the revolute pairs hardly slides relative to another and the rotational-phase fluctuation of the driven shaft is restricted.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT (First Embodiment)

Figure 2:
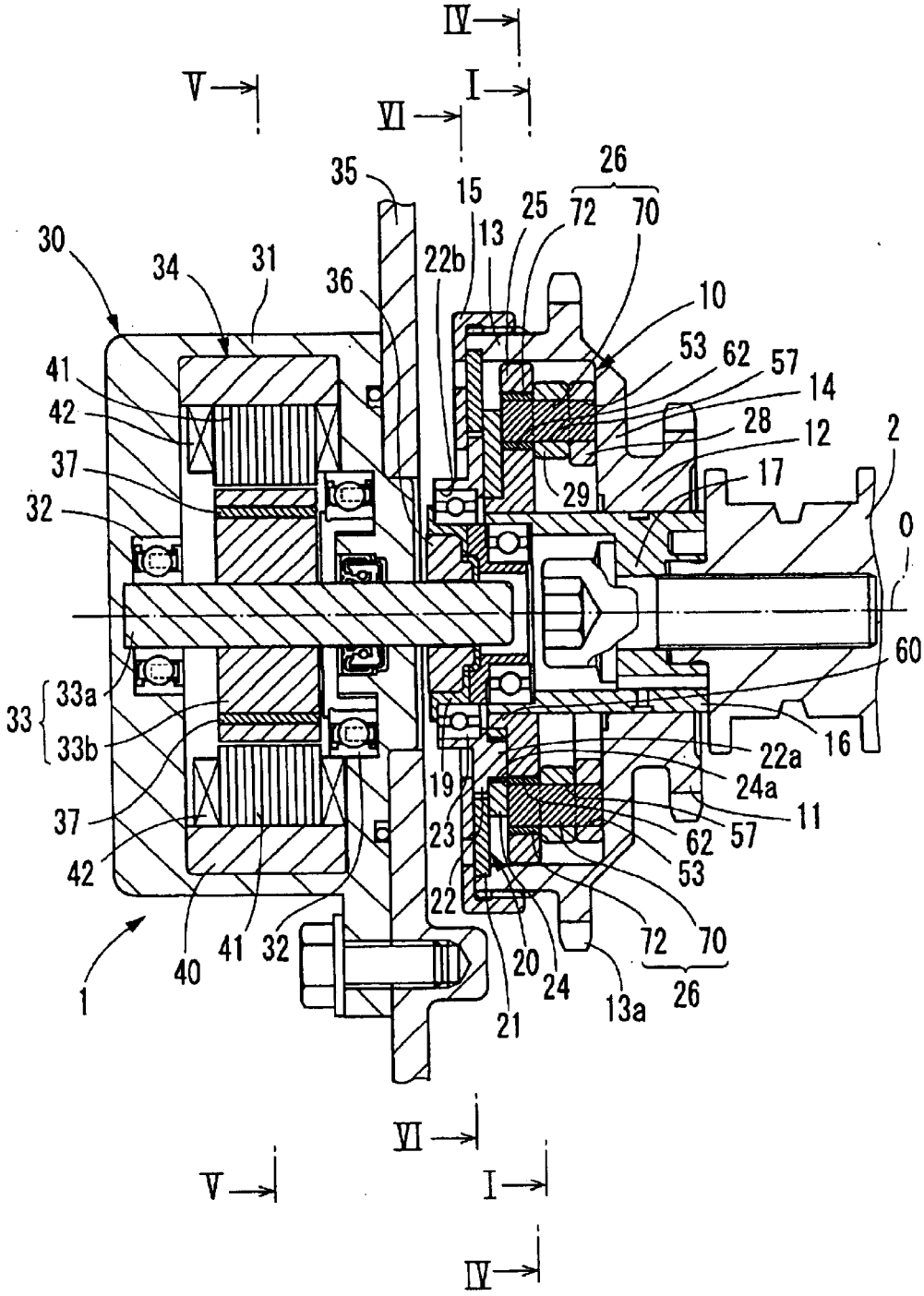
FIG. 2 is a longitudinal sectional view along a line II—II in FIG. 1.

FIG. 2 shows a VVT controller according to the first embodiment of the present invention. The VVT controller 1 is disposed in a torque transfer system which transfers the torque of a crankshaft to a camshaft which opens and closes at least one of an intake valve or an exhaust valve. The crankshaft is a driving shaft and the camshaft is a driven shaft in this embodiment. The VVT controller 1 adjusts the valve timing of intake valve by varying the rotational phase of the camshaft 2 relative to the crankshaft.

Figure 1:
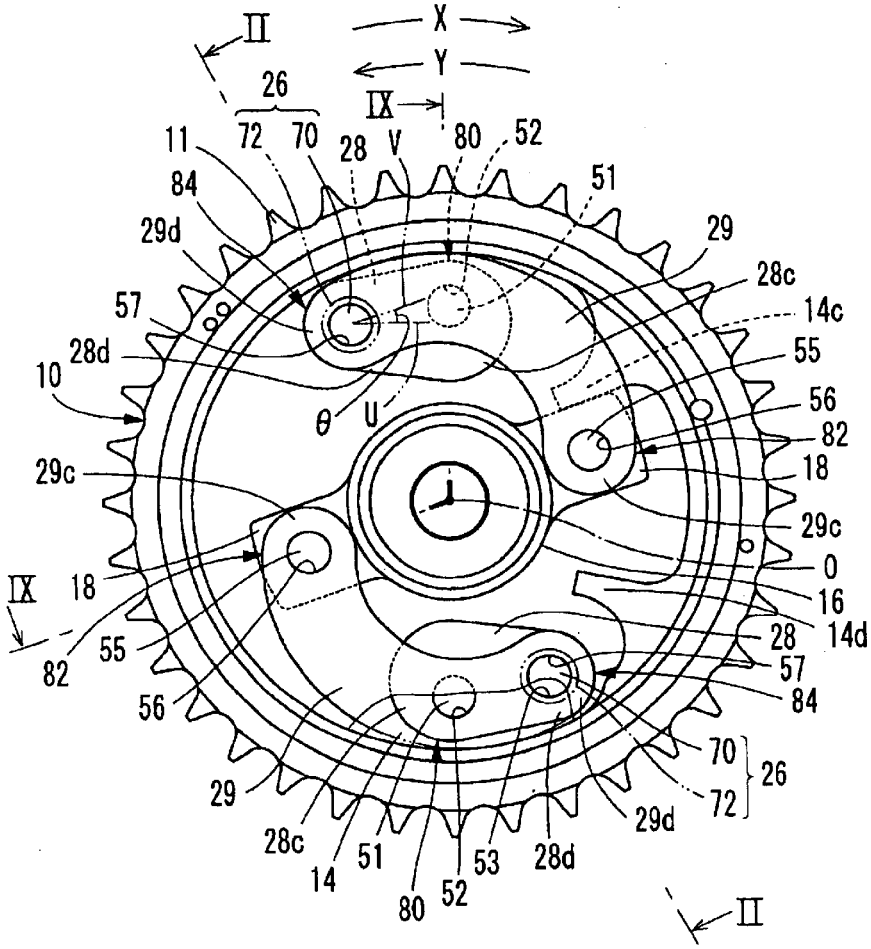
FIG. 1 is a cross sectional view of the VVT controller along a line I—I in FIG. 2 according to the first embodiment.

A phase adjusting mechanism 10 shown in FIGS. 1 and 2 has a sprocket 11, an output shaft 16, a first arm 28 and a second arm 29. The phase adjusting mechanism 10 varies a rotational phase of the camshaft 2 relative to a crankshaft (not shown). In FIGS. 1, 4, 7 and 8, hatching to show cross section are omitted.

The sprocket 11 has a supporting portion 12, an input portion 13 having a larger diameter than that of the supporting portion 12, and a link portion 14 connecting the supporting portion 12 with the input portion 13. The supporting portion 12 is rotatively supported by the output shaft 16 around a center axis "O". A chain belt (not shown) runs over a plurality of gear tooth 13*a* formed on the input portion 13 and a plurality of gear tooth formed on the crankshaft. When the torque is transmitted from the crankshaft to the input portion 13 through a chain belt, the sprocket 11 rotates clockwise around the center axis "O" with keeping the rotational phase unchanged relative to the crankshaft. The sprocket 11, which is a first rotational member, rotates in synchronism with the crankshaft.

The output shaft 16, which is the driven shaft, has a fixed portion 17 and a link portion 18. One end of the camshaft 2 is concentrically coupled to the fixed portion 17 by a bolt, and the output shaft 16 rotates around the center axis "O" with keeping the rotational phase to the camshaft 2. That is, the output shaft 16 is the second rotational member which rotates in synchronism with the camshaft 2.

The first arm 28 and the second arm 29 are sandwiched between a cover 15 fixed to the input portion 13 and the link portion 14 along with the link portion 18, a guide member 25, movable member 26 and reduction gears 20. The reduction gears 20 have a planet gear 22 and a transfer member 24. The first arm 28 is connected with a link portion 14 rotatively and the second arm 29 is connected with the link portion 14 and the first arm 28 rotatively. The output shaft 16 rotates clockwise in FIG. 1 as well as the sprocket 11 rotates according to the rotation of the crankshaft. Furthermore, the output shaft 16 can rotate in advance direction X and delay direction Y relative to the sprocket 11 in FIG. 1. The first arm 28 and the second arm 29 are rotatively connected with each other by the movable member 26. The first and second arms 28, 29 are displaced according to the movement of the movable member 26, and the displacement of the arms 28, 29 is converted into the relative rotational movement of the output shaft 16 relative to the sprocket 11.

Figure 3:
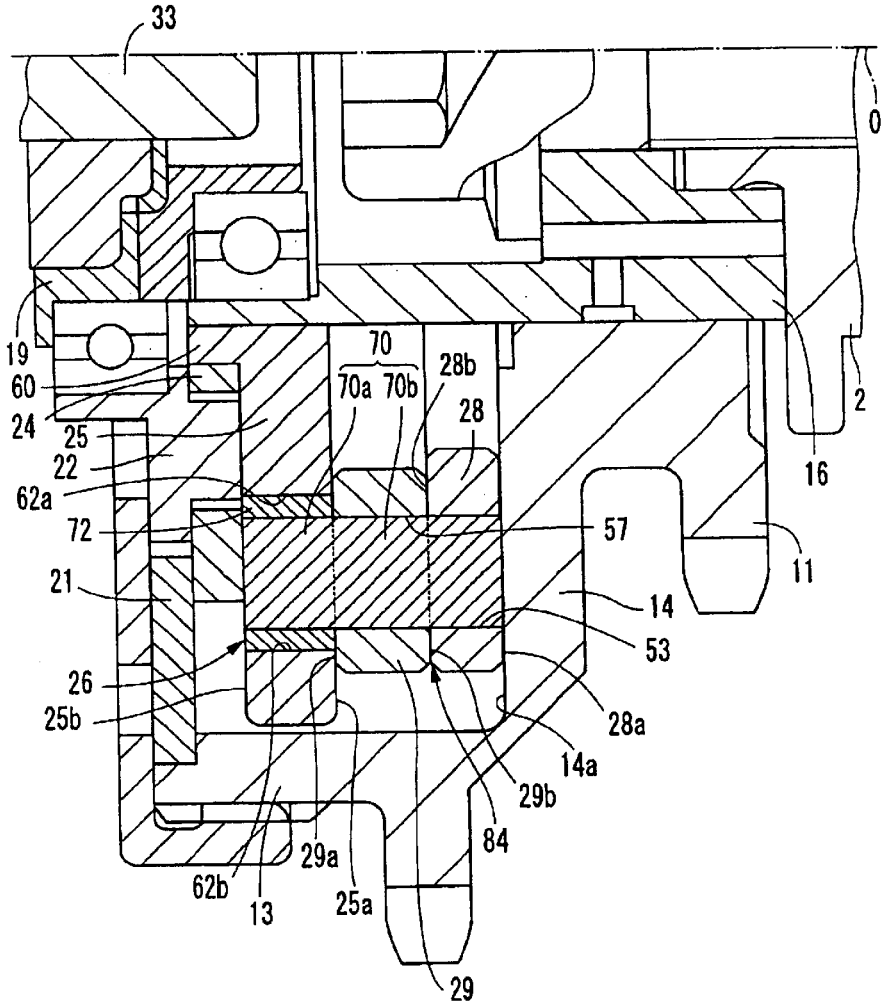
FIG. 3 is a partially enlarged view of FIG. 2.
Figure 4:
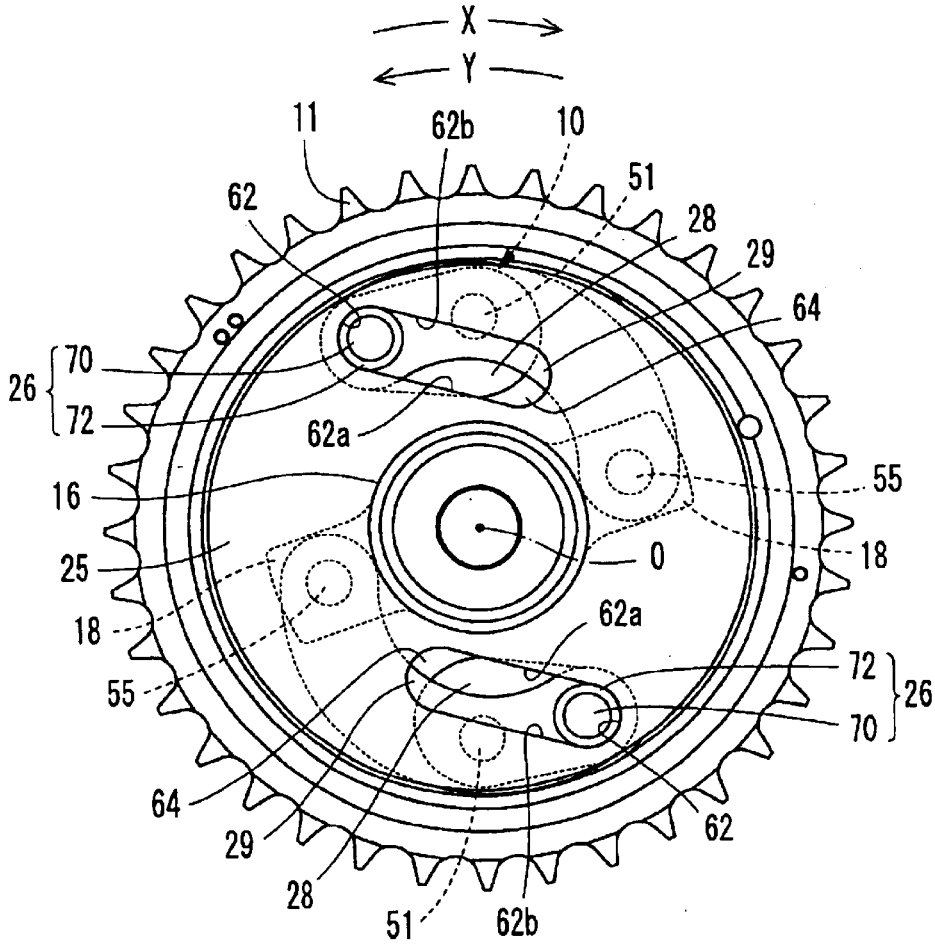
FIG. 4 is a cross sectional view along a line IV—IV in FIG. 2.

As shown in FIGS. 2 to 4, the guide member 25 is disk-shaped and side surfaces 25*a*, 25*b* thereof are vertical to the center axis "O". The guide member 25 is provided with a protrusion 60 protruding from the side surface 25*b*. The transfer member 24 is engaged with the guide member 25, thus the guide member 25 and the transfer member 24 rotate together around the center axis "O". The guide member 25 has two guide slots 62, 62 to introduce the movable member 26. The guide slots 62, 62 are opened on the side surfaces 25*a*, 25*b* of the guide member 25 and are symmetric with respect to the center axis "O". Each of the guide slots 62, 62 has inner surfaces 62*a*, 62*b* which forms a straight guide passage 64. The guide passage 64 is inclined with respect to the radial direction of the guide member 25 in such a manner that the distance between the guide passage 64 and the center axis "O" varies. In this embodiment, outer end of the guide passage 64 is heading to the delay direction Y as shown in FIG. 4.

The movable member 26 is of column and is comprised of a column body 70 and a sleeve 72. Each guide slot 62 receives the movable member 26 respectively. The sleeve 72 is of cylinder and covers one end 70*a* of the column body 70 concentrically. The column body 70 is sandwiched between the transfer member 24 and the link portion 14, and the sleeve 72 is sandwiched between the transfer member 24 and the second arm 29. A center axis of the movable member 26 is eccentric to the center axis "O". The sleeve 72 is slidablly contacted with the inner surfaces 62*a*, 62*b* of the guide slot 62. That is, the sleeve 72 is rotatively engaged with the guide slot 62 and slides along the guide passage 64 relatively.

Figure 5:
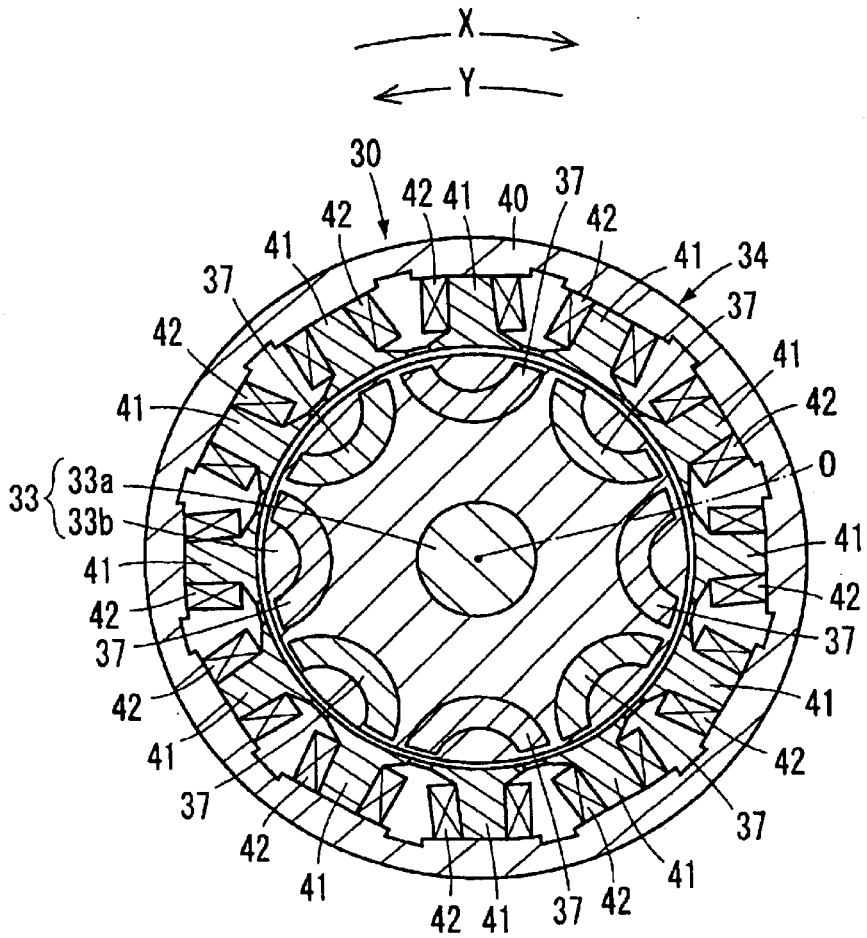
FIG. 5 is a cross sectional view along a line V—V in FIG. 2.

An electric motor 30 shown in FIGS. 2 and 5 is comprised of a housing 31, a bearing 32, a motor shaft 33 and a stator 34. The housing 31 is fixed on the engine through a stay 35. The housing 31 accommodates a pair of bearing 32 and the stator 34.

The motor shaft 33 is supported by the pair of bearing 32 and rotates around the center axis "O". The motor shaft 33 is connected with an eccentric shaft 19 through a joint 36 so that the motor shaft 33 rotates clockwise with the eccentric shaft 19 in FIG. 5. The motor shaft 33 has a shaft body 33*a* and a disk-shaped rotor 33*b*. A plurality of magnets 37 is disposed in the rotor 33*b* near the outer periphery. The magnets 37 are made from rare-earth magnets and are disposed around the center axis "O" at regular intervals.

The stator 34 is located around the motor shaft 33 and has a cylindrical body 40, a core 41 and a coil 42. The core 41 is formed by stacking a plurality of iron plates and protrudes toward the motor shaft 33 from the inner surface of the body 40. The core 41 has twelve protrusions in same pitch, and the coil 42 is wound on each protrusions. The stator 34 generates a magnetic field around the motor shaft 33 based on the electric current supplied to the coil 42. The electric current is controlled by an electric circuit (not shown) in order to apply a torque to the motor shaft 33 in a delay direction Y or an advance direction X. When the coil 42 generates the magnetic field in a counter clockwise direction in FIG. 5, the magnets 37 receive attracting force and repelling force and the motor shaft 33 rotates in the delay direction Y. On the other hand, when the coil 42 generates the magnetic field in a clockwise direction, the motor shaft 33 rotates in the advance direction X.

Reduction gears 20 are comprised of a ring gear 21, the eccentric shaft 19, the planet gear 22, a bearing 23 and the transfer member 24. The ring gear 22 is fixed on the inner surface of the input portion 13 concentrically. The ring gear 22 is an internal gear of which an addendum circle is inside of a dedendum circle. The ring gear 22 rotates clockwise around the center axis "O" in FIG. 6.

Figure 6:
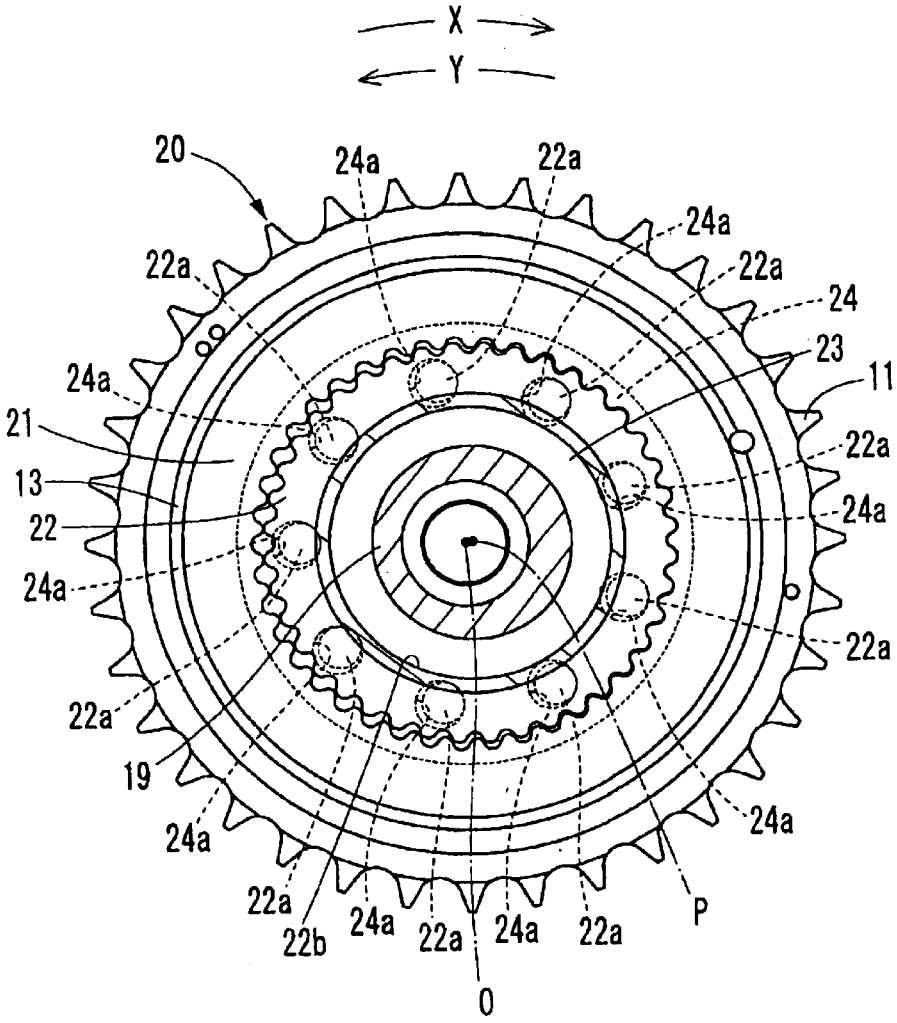
FIG. 6 is a cross sectional view along a line VI—VI in FIG. 2.
Figure 7:
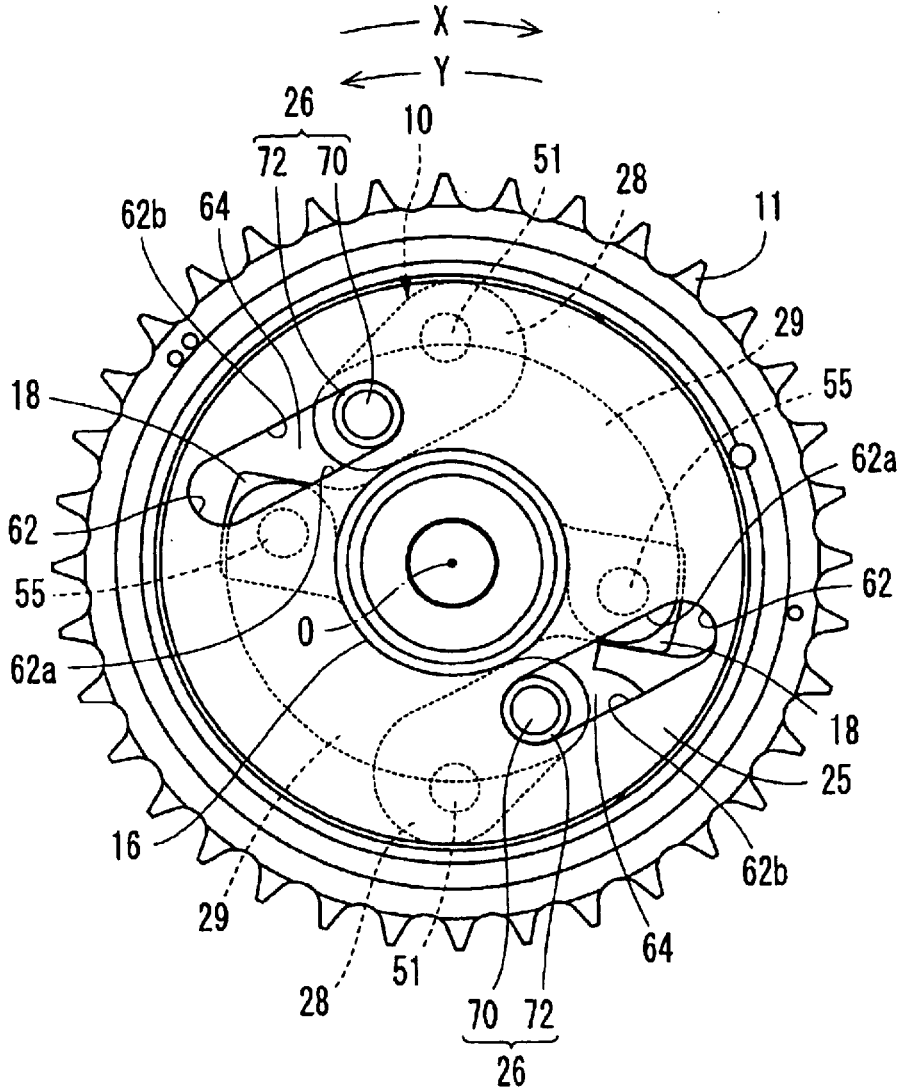
FIG. 7 is a cross sectional view corresponding to FIG. 4 for explaining an operation of VVT controller.

The eccentric shaft 19 is connected with the motor shaft 33 of the electric motor 30 in such a manner that the eccentric shaft 19 is offset relative to the center axis "O". In FIG. 6, "P" represents an axis of the eccentric shaft 19.

The planet gear 22 is comprised of an external gear of which an addendum circle is outside of a dedendum circle.

A curvature of the addendum circle of the planetary gear 22 is smaller than that of the dedendum circlet of the ring gear 21. The planet gear 22 has one less tooth than the ring gear 21. The planet gear 22 is located inside of the ring gear 21 with engaging a part of teeth of the planet gear 22 with a part of teeth of the ring gear 21. The planet gear 22 has a circular engage hole 22*b* concentrically. One end of the eccentric shaft 19 is inserted into the circular engage hole 22*b* through the bearing 23. Thereby, the eccentric shaft 19 and the motor shaft 33 can rotate in advance direction X or in delay direction Y relative to the sprocket 11.

The transfer member 24 is of a circular plate and is disposed in such a manner that both side thereof are vertical to the center axis "O". The transfer member 24 has plural engage holes 24*a* which are arranged around the center axis "O" at regular intervals. The planet gear 22 has engage projections 22*a* which are disposed around the axis "P" of the eccentric shaft 19 and are engaged with the engage hole 24*a*.

When the control torque is not transmitted from the motor shaft 33 to the eccentric shaft 19, the planet gear 22 does not rotate relative to the eccentric shaft 19. As the crankshaft rotates, the planet gear 22 engaging with the ring gear 21 rotates together with the sprocket 11, the eccentric shaft 19 and the motor shaft 33 without changing of the rotational phase of the planet gear 22 relative to the ring gear 21. The engage projection 22*a* urges the inner surface of the engage hole 24*a* toward the advance direction X, and the guide member 25 and transfer member 24 rotate clockwise in FIG. 6 around the center axis "O" with keeping the rotational phase unchanged relative to sprocket 11. The movable member 26 does not slide in the guide passage 64 and the distance between the movable member 26 and the center axis "O" is kept constant. Thus, the movable member 26 rotates with the guide member 25.

When the control torque is transmitted from the motor shaft 33 to the eccentric shaft 19 in the delay direction Y, the inner surface of the planet gear 22 is urged by the bearing 23 and then the planet gear 22 rotates in the advance direction X. At the same time, the planet gear 22 partially engaging with the ring gear 21 rotates in the advance direction X relative to the sprocket 11. Since the engage projection 22*a* urges the inner surface of the engage hole 24*a* by an increasing force, the transfer member 24 and the guide member 25 rotate in the advance direction X relative to the sprocket 11. The control torque in the delay direction Y is converted into the torque in the advance direction X and is increased by the reduction gears 20. In such a torque transmission, the movable member 26 slides in the guide slot 62 in the delay direction and the distance between the movable member 26 and the center axis "O" becomes large.

When the control torque is transmitted from the motor shaft 33 to the eccentric shaft 19 in the advance direction X, the inner surface of the planet gear 22 is urged by the bearing 23 and then the planet gear 22 rotates relative to the eccentric shaft 19 in the delay direction Y. At the same time, the planet gear 22 rotates relative to the sprocket 11 in the delay direction Y with partially engaging with the ring gear 21. Thereby, the engage projection 22*a* urges the engage hole 24*a* toward the delay direction Y, and the guide member 25 and the transfer member 24 rotate relative to the sprocket 11 in the delay direction Y. The control torque in the advance direction X is converted into the torque in the delay direction Y and is increased by the reduction gears 20 to be transferred from the transfer member 24 to the guide member 25. In such a torque transmitting, the movable member 26 slides in the guide passage 64 in the advance direction X and the distance between the movable member 26 and the central axis "O" decreases.

The electric motor 30 generates the control torque, the reduction gears 20, which is an actuator, transfers the control torque to the guide member 25.

Figure 8:
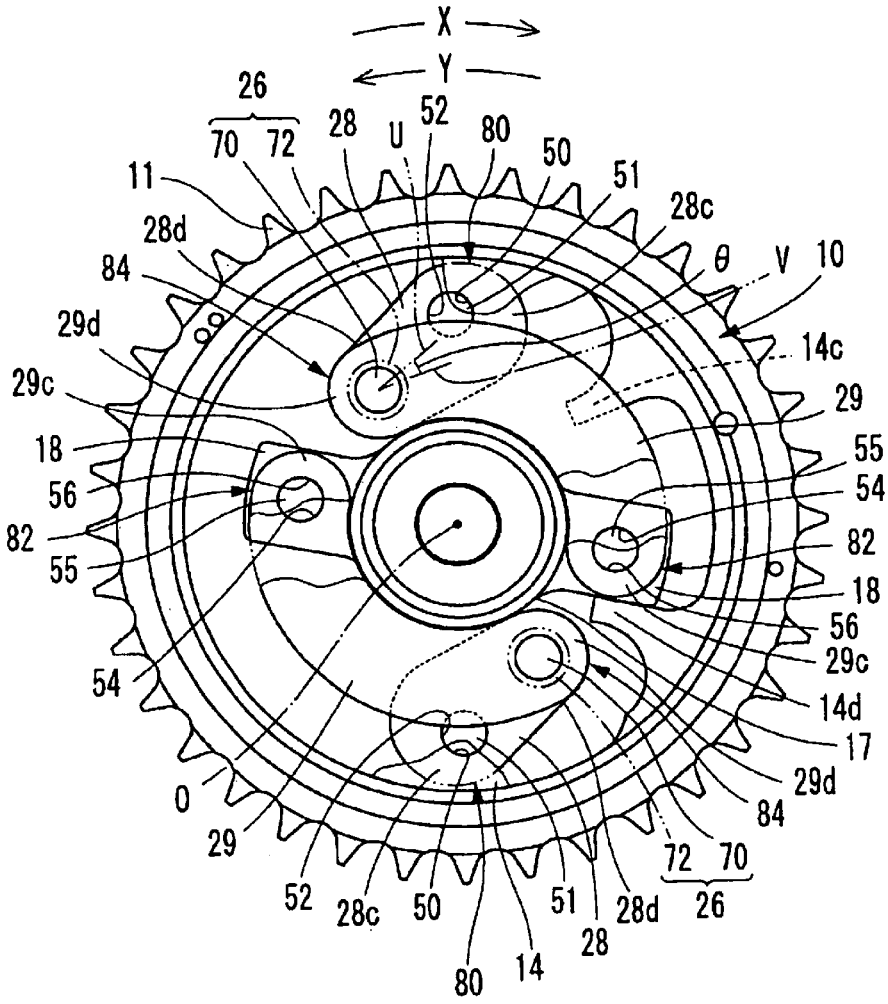
FIG. 8 is a cross sectional view corresponding to FIG. 1 for explaining an operation of VVT controller.

FIGS. 1 to 3 and 8 to 11 shows the phase adjusting mechanism 10 in detail. FIG. 1 shows that the output shaft 16 is positioned in the most delayed phase relative to the sprocket 11, and FIG. 8 shows that the output shaft 16 is positioned in the most advanced phase.

Figure 9:
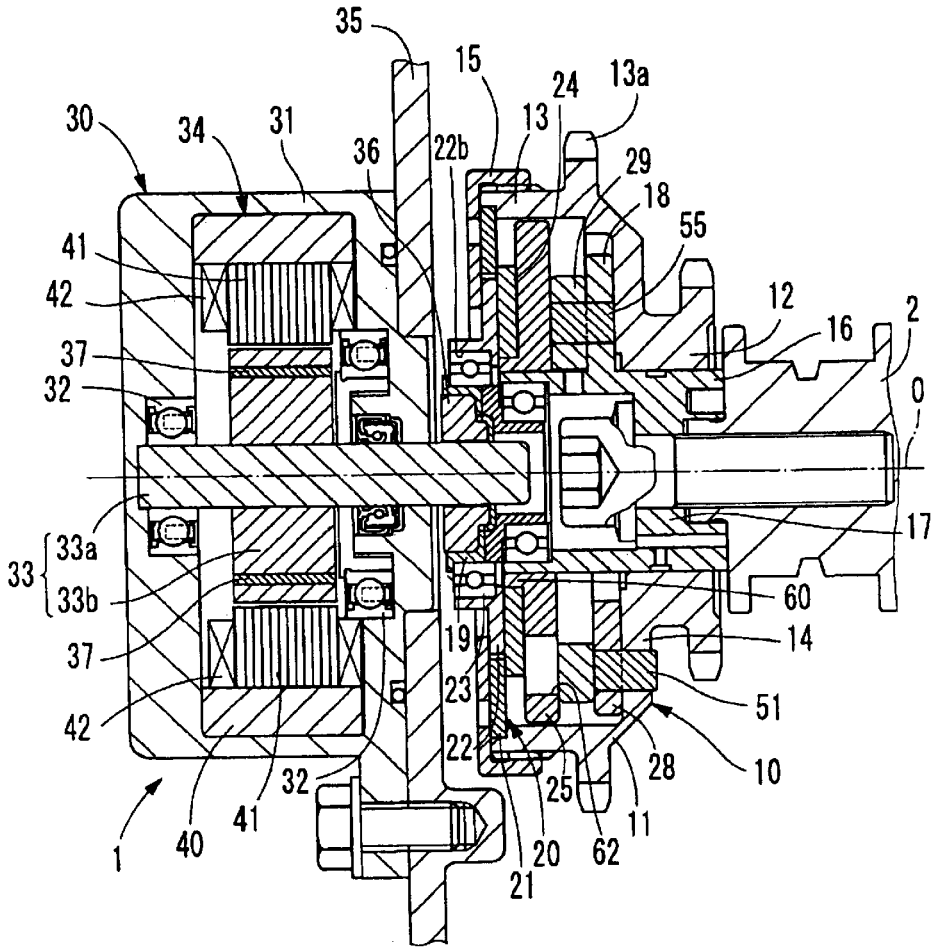
FIG. 9 is a longitudinal sectional view along a line IX—IX in FIG. 1.
Figure 10:
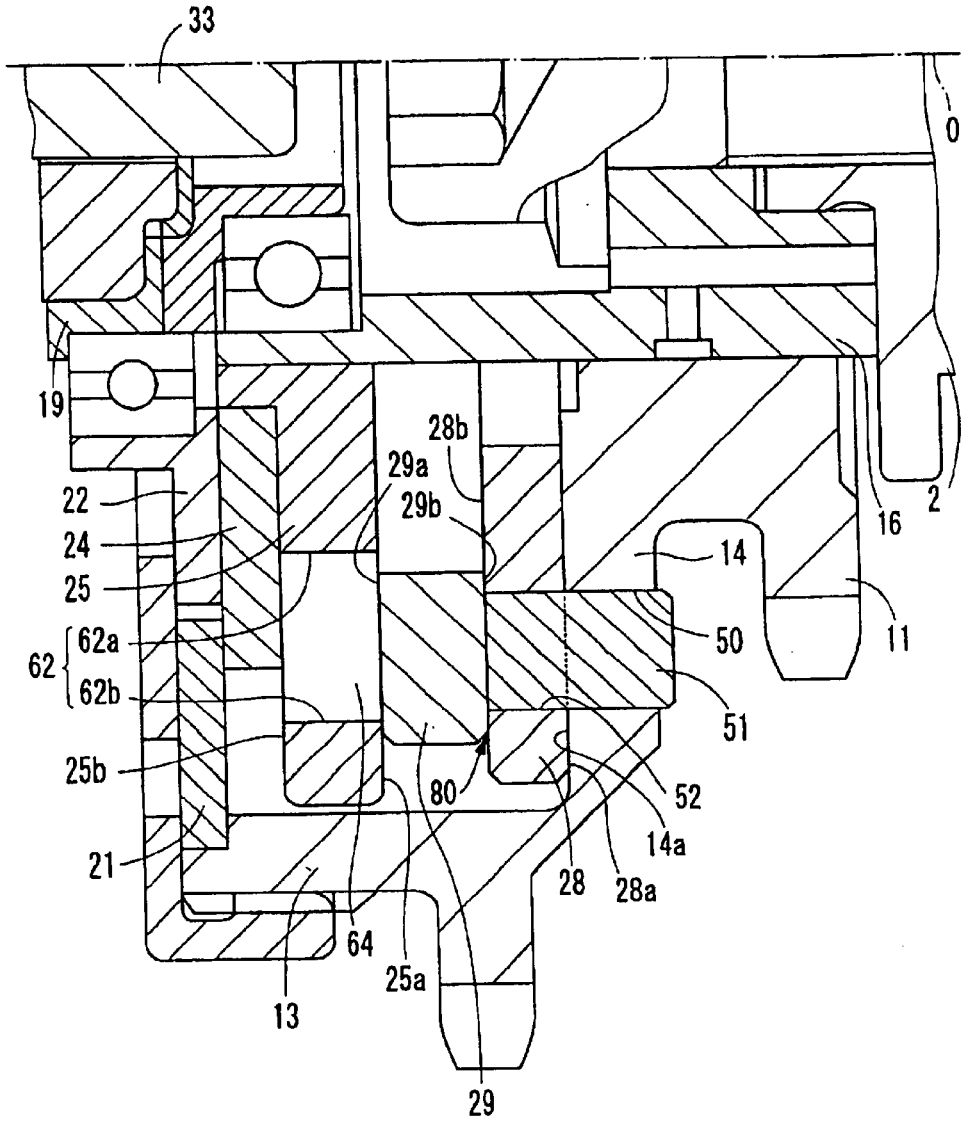
FIG. 10 is a partially enlarged view of FIG. 9.

The link portion 14 as shown in FIGS. 8 to 10 is positioned in such manner that the side surface 14*a* thereof is orthogonal to the center axis "O". The link portion 14 has two holes 50, 50 around the center axis "O". Cylindrical pins 51, 51 are rotatively inserted into the each hole 50 at one end respectively. The first arm 28 is an egg-shaped plate and is engaged with the cylindrical pin 51. Both side surface 28*a*, 28*b* of the first arm 28 are vertical to the center axis "O". At one end 28*c* of the first arm 28, there is provided an engage hole 52 of which a centerline is offset to the center axis "O". The cylindrical pin 51 is rotatively inserted into the engage hole 52 of the first arm 28. The side surface 28*a* of the first arm 28 is contact with the side surface 14*a* of the link portion 14 around the engage hole 52. A revolute pair 80 of the link portion 14 and the first arm 28 is comprised of the hole 50, the engage hole 52 and the cylindrical pin 51.

Figure 11:
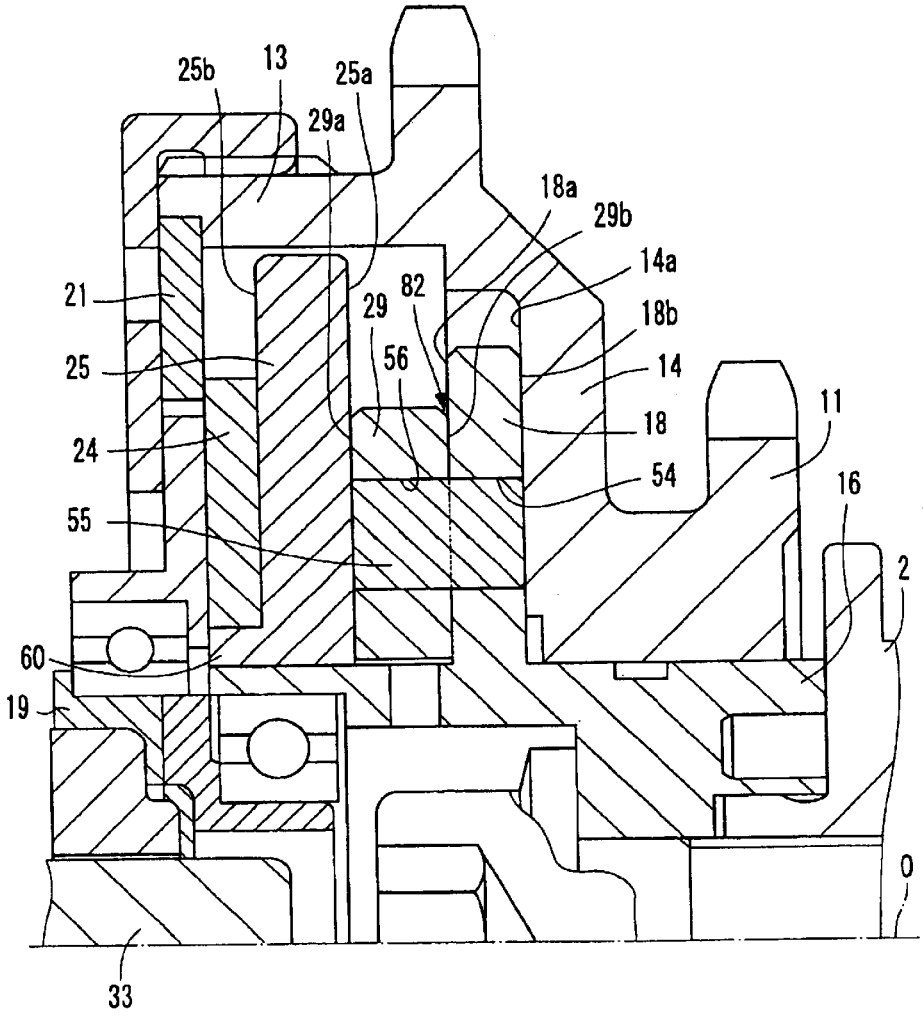
FIG. 11 is a partially enlarged view of FIG. 9.

As shown in FIGS. 8, 9 and 11, the output shaft 16 has two link portions 18 which are projected from the fixed portion 19 toward opposite direction around the center axis "O". Both side surfaces 18*a*, 18*b* are vertical to the center axis "O", and one side surface 18*b* is contact with the side surface 14*a* of the link portion 14. Each of the link portions 18 is square-shaped, and side surface 18*b* is contact with the side surface 14& of the link portion 14. As shown in FIG. 1, one of the link portions 18 abuts on a delay-side stopper 14*c* of the link portion 14 when the rotational phase of the output shaft 16 is in the most delayed phase. When the rotational phase of the output shaft 16 is in the most advanced phase, the link portion 18 abuts on an advance-side stopper 14*d* as shown in FIG. 8. Each link portion 18 has a hole 54 at top end thereof, the hole 54 having a center line offset to the center axis "O". Each of two cylindrical pins 55 is rotatively inserted into the holes 54 respectively. The second arm 29 is of C-shape and is engaged with the cylindrical pin 55. Both side surfaces 29*a*, 29*b* of the second arm 29 are vertical to the center axis "O" and one side surface 29*a* is contact with the side surface 25*a* of the guide member 25. The second arm 29 has a hole 56 at one end 29*c* thereof, the hole 56 having a center line offset to the center axis "O". The cylindrical pin 55 is rotatively inserted into the hole 56 of the second arm 29. The side surface 29*b* is contact with the side surface 18*b* of the link portion 18 around the hole 56. In the present embodiment, a rotational pair 82 of the link portion 18 and the second arm 29 is comprised of the hole 54, the hole 56 and the cylindrical pin 55.

As shown in FIGS. 1 to 3, the first arm 28 has a hole 53 at the other end 28*d* thereof, the hole 53 having a center line offset to the center axis "O". The second arm 29 has a hole 57 at the other end 29*d* thereof, the hole 57 having a center line offset to the center axis "O". The column body 70 of the movable member 26 is rotatively inserted into the holes 53, 57 at the portion 70*a*. The side surface 29*b* of the second arm 29 is contact with the side surface 28*b* of the first arm 28 around the hole 57. The width of the first arm 28 increases along to the longitudinal axis thereof so that the contact area between the first arm 28 and the second arm 29 is relatively small to reduce the friction. A revolute pair 84 of the first arm 28 and the second arm 29 is comprised of the hole 53, the hole 57 and the movable member 26.

As shown in FIGS. 1 and 8, the first arm 28 has shorter length than that of the second arm 29. The angle θ between the longitudinal axis U of the first arm 28 and the longitudinal axis V of the second arm 29 varies from −90° angle to +90° angle according to the operation of the phase adjusting mechanism 10. The revolute pair 82, the revolute pair 80 and the revolute pair 84 are arranged in this order in the delay direction Y, whereby the phase adjusting mechanism 10 is made compact.

When the firm arm 28 has a longer length than that of the second arm 29, the revolute pair 80, the revolute pair 82 and the revolute pair 84 are arranged in this order in the delay direction Y.

Referring to FIGS. 1 and 8, the operation of the phase adjusting mechanism 10 is described herein after. When the distance between the center axis "O" and the movable member 26 is kept unchanged, the relative positions of the revolute pair 84, the revolute pair 82 and the revolute pair 80 are not changed. Since the output shaft 16 simultaneously rotates with camshaft 2 with keeping the rotational phase unchanged relative to the sprocket 11, the rotational phase of the camshaft 2 relative to the crankshaft is kept unchanged. The rotational phase of the camshaft 2 is referred to as the shaft phase hereinafter.

When the distance between the movable member 28 and the center axis "O" increases, the first arm 28 rotates around the cylindrical pin 51 and the movable member 26 relative to the link portion 14 and the second arm 29 so that the pair of rotation 84 moves away from the central axis "O" according toe the movement of the movable member 26. At the same time, the second arm 29 rotates around the cylindrical pin 55 relative to the link portion 18, and the revolute pair 82 moves close to the revolute pair 80 in the delay direction Y according to the movement of the movable member 26. The output shaft 16, thereby, rotates in the delay direction Y relative to the sprocket 11 and the shaft phase is delayed.

When the distance between the movable member 26 and the center axis "O" decreases, the first arm 28 rotates around the cylindrical pin 51 and the movable member 26 relative to the link portion 14 and the second arm 29 so that the revolute pair 84 moves toward the center axis "O". At the same time, the second arm 29 rotates around the cylindrical pin 55 relative to the link portion 18 and the revolute pair 82 moves away from the revolute pair 80 in the advance direction X. The output shaft 16, thereby, rotates in the advance direction X relative to the sprocket 11 and the shaft phase is advanced.

In the phase adjusting mechanism 10 described above, the positions of the first arm 28 and the second arm 29 are controlled according to the movement of the movable member 26 so that the shaft phase is varied by converting the movement of the first arm 28 and the second arm 29 into the rotational movement of the output shaft 16 relative to the sprocket 11. It is important to restrain the fluctuation of the shaft phase due to the force, such as engine torque fluctuation, applied to the camshaft 4. In the phase adjusting mechanism 10, since the sprocket 11 and the first arm 28, and the output shaft 16 and the second arm 29 are connected with each other rotatively, the relative movements there between are not occurred. Thus, even if some forces are applied to the phase adjusting mechanism 10, the shaft phase is kept constant.

(Second Embodiment)

Figure 12A:
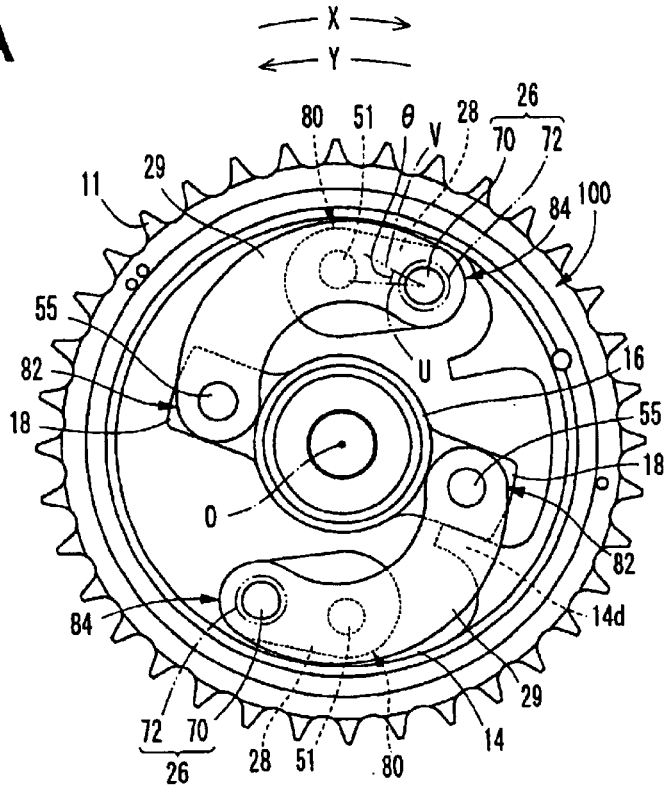
FIG. 12A is a cross sectional view corresponding to FIG. 1 according to a second embodiment.
Figure 12B:
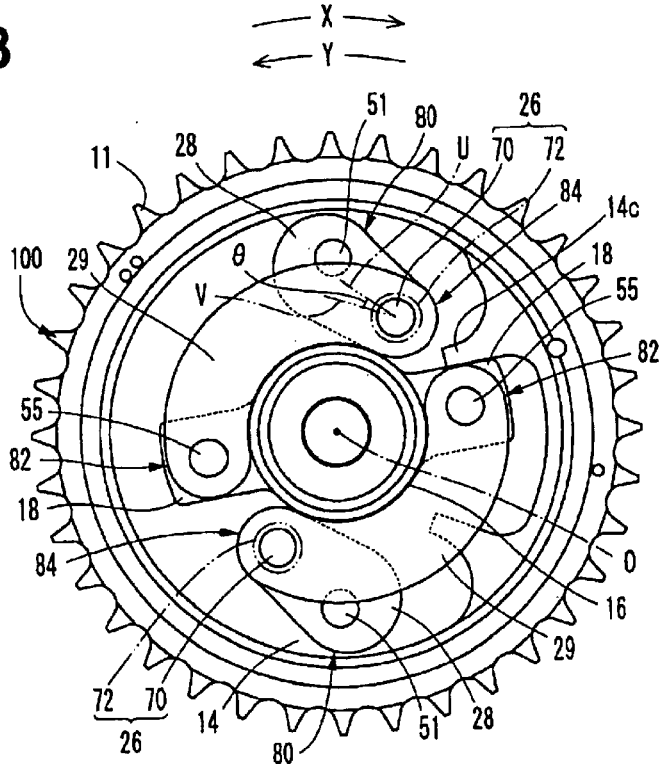
FIG. 12B is a cross sectional view corresponding to FIG. 8 according to the second embodiment.

A VVT controller according to the second embodiment of the present invention is described in FIG. 12. The second embodiment is a modification of the first embodiment, and the substantially same parts and components as those in the first embodiment are indicated with the same reference numerals.

In the phase adjusting mechanism 100, the first arm 28 and the second arm 29 has the same length and the same angle θ as those in the first embodiment. The revolute pair 82, the revolute pair 80 and the revolute pair 84 are arranged in this order in the delay direction Y to reduce the size thereof.

The operation of the phase adjusting mechanism 100 is described herein after. When the distance between the movable member 26 and the center axis "O" increase, the first arm 28 moves the revolute pair 84 away from the center axis "O" according to the movement of the movable member 26, and the second arm 29 moves the revolute pair 82 in the advance direction X relative to the revolute pair 80. The output shaft 16, thereby, rotates in the advance direction relative to the sprocket 11 and the shaft phase is advanced.

On the other hand, when the distance between the movable member 26 and the center axis "O" decreases, the first arm 28 moves the revolute pair 84 close to the center axis "O" and the second arm 29 moves the revolute pair 82 in the delay direction Y relative to the revolute pair 80. The output shaft 16, thereby, rotates in the delay direction Y relative to the sprocket 11 and the shaft phase is delayed.

The revolute pair 80, the revolute pair 82 and the revolute pair 84 can be arranged in this order in the delay direction Y by making the length of the first arm 28 than that of the second arm 29.

(Third Embodiment)

Figure 13A:
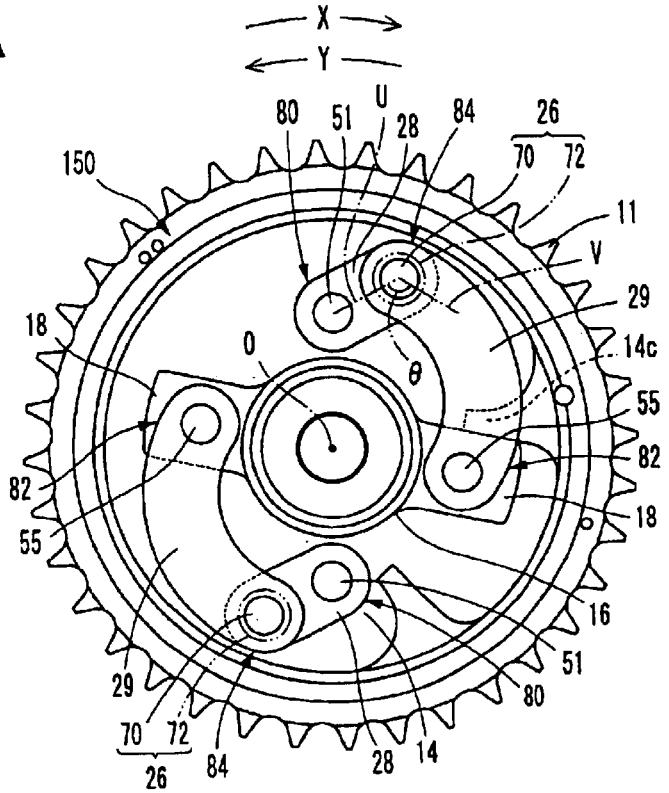
FIG. 13A is a cross sectional view corresponding to FIG. 1 according to a third embodiment.
Figure 13B:
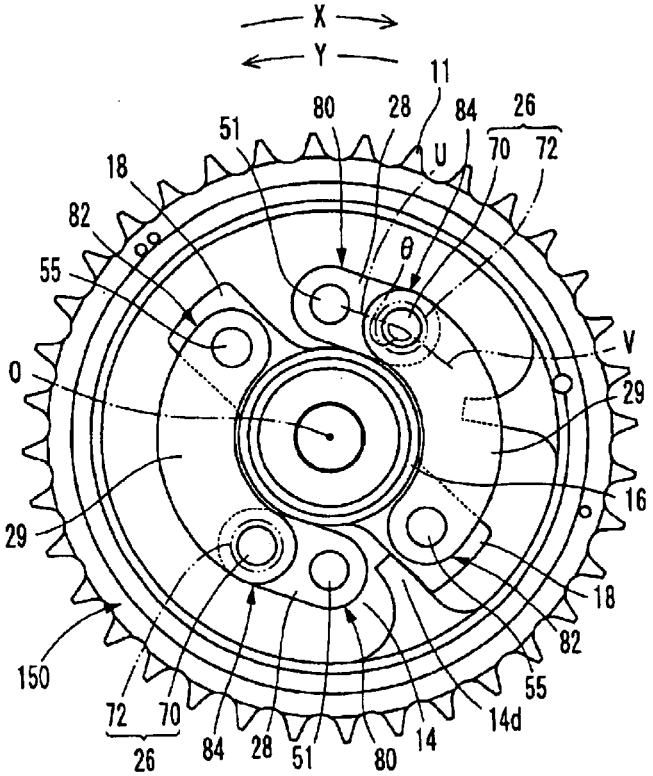
FIG. 13B is a cross sectional view corresponding to FIG. 8 according to the third embodiment.

FIG. 13 shows a third embodiment of the present invention. The third embodiment is a modification of the first embodiment, and the substantially same parts and components as those in the first embodiment are indicated with the same reference numerals.

A phase adjusting mechanism 150 includes the first arm 28 and the second arm 29 having the same length as those of the first embodiment. The angle θ between the first arm 28 and the second arm 29 varies from 90° angle to 180° angle. The revolute pair 82, the revolute pair 84 and the revolute pair 80 are arranged in this order in the delay direction Y.

The operation of the phase adjusting mechanism 150 is described herein after. When the distance between the movable member 26 and the center axis "O" increases, the first arm 28 moves the revolute pair 84 away from the center axis "O" and the second arm 29 moves the revolute pair 82 in the delay direction Y relative to the revolute pair 80. Thereby, the output shaft 19 rotates in the delay direction Y relative to the sprocket 11 and the shaft phase is delayed.

On the other hand, when the distance between the movable member 26 and the center axis "O" decreases, the first arm 28 moves the revolute pair 28 close to the center axis "O" and the second arm 29 moves the revolute pair 82 in the advance direction X. Thereby, the output shaft 16 rotates in the advance direction X relative to the sprocket 11 and the shaft phase is advanced.

Figure 14A:
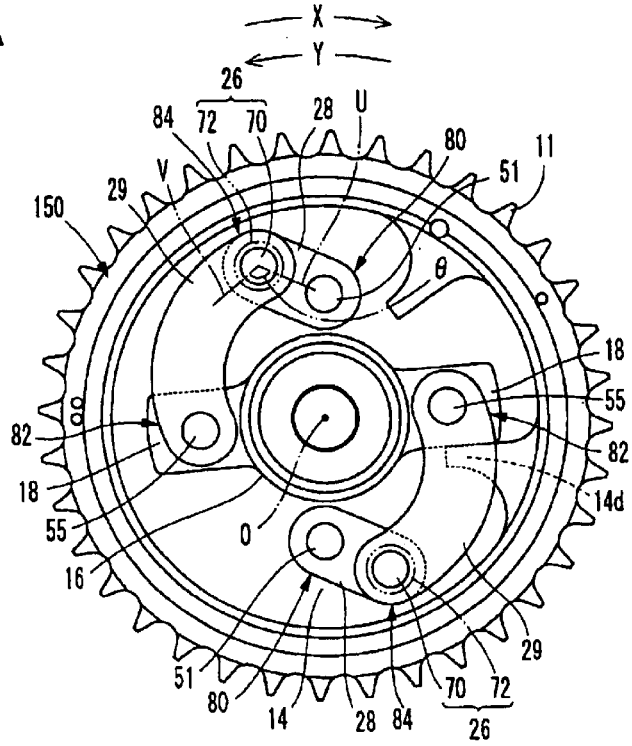
FIG. 14A is a cross sectional view corresponding to FIG. 1 according to a modification of the third embodiment.
Figure 14B:
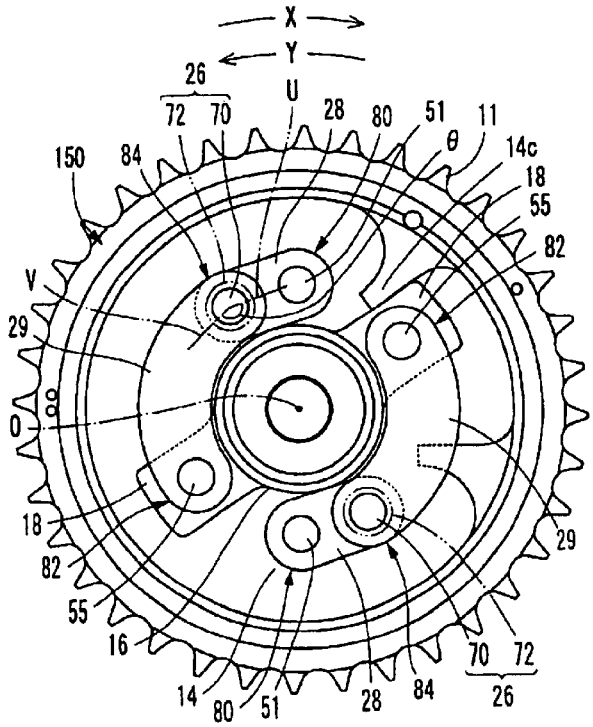
FIG. 14B is a cross sectional view corresponding to FIG. 8 according to a modification of the third embodiment.

As shown in FIG. 14, the revolute pair 82, the revolute pair 84 and the revolute pair 80 can be arranged in this order in the delay direction Y. The operation of the phase adjusting mechanism 150 is the same as those in the second embodiment.

(Fourth Embodiment)

Figure 15:
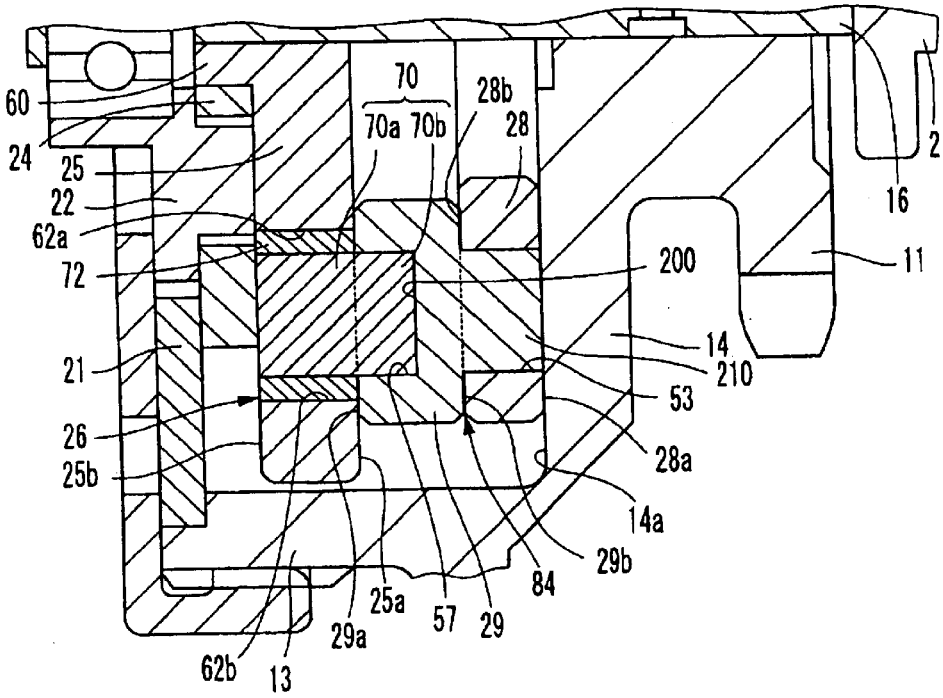
FIG. 15 is a partially enlarged view corresponding to FIG. 3 according to a fourth embodiment.

A VVT controller according to a fourth embodiment of the present invention is described in FIG. 15. The fourth embodiment is a modification of the first embodiment, and the substantially same parts and components as those in the first embodiment are indicated with the same reference numerals.

The column body 70 of each movable member 26 is sandwiched between a bottom surface 200 of the hole 57 cup-shaped and the transfer member 24. The end portion 70*b* of the column body 70 is inserted into the hole 57 of the second arm 29 but the hole 53 of the first arm 29. Each second arm 29 has a cylindrical pin 210 projecting integrally from the side surface 29*b* of the second arm 29, the cylindrical pin 210 being rotatively inserted into the hole 53 of the first arm 28. The revolute pair 84 of the first arm 28 and the second arm 29 is formed by the rotational engagement of the hole 53 and the cylindrical pin 210.

The cylindrical pin 210 can be made separately from the second arm 29 to be press-fitted into the second arm 29 or to be integrated by welding.

(Fifth Embodiment)

Figure 16A:
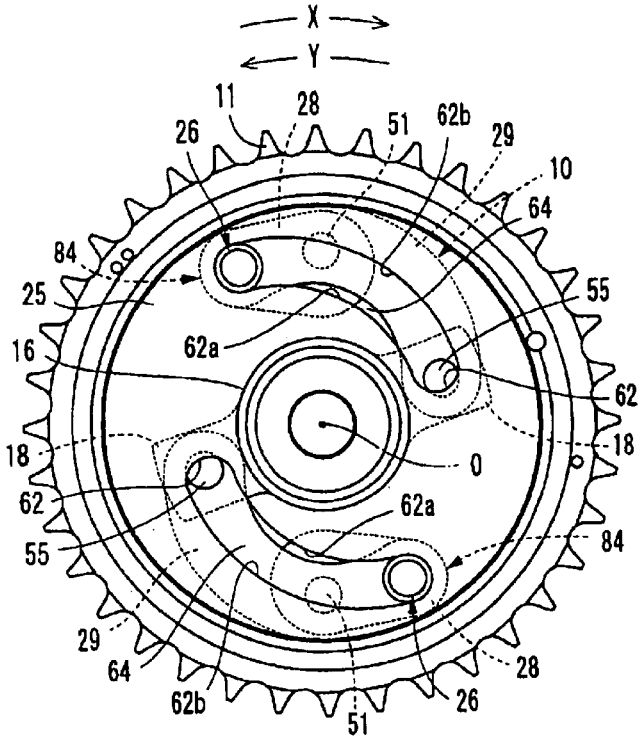
FIG. 16A is a cross sectional view corresponding to FIG. 4 according to a fifth embodiment.
Figure 16B:
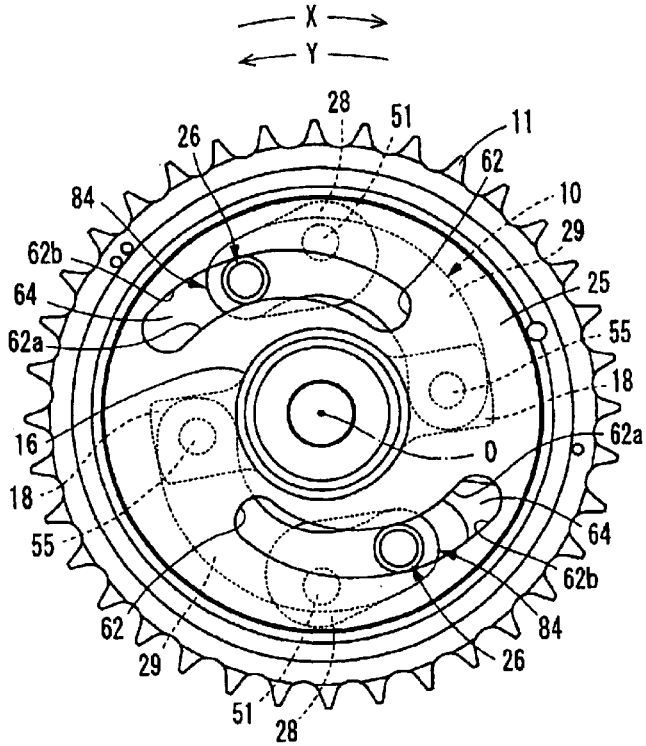
FIG. 16B is a cross sectional view to show another operational state according to the fifth embodiment.

A WT controller according to a fifth embodiment of the present invention is described in FIG. 16. The fifth embodiment is a modification of the first embodiment, and the substantially same parts and components as those in the first embodiment are indicated with the same reference numerals.

The guide passage 64 in the guide member 25 is formed in such a manner that the curvature of the passage 64 is varies gradually around the center axis "O". That is, the passage 64 is inclined to the radial direction of the guide member 25 in such a manner that the radial distance between the center axis "O" and the passage 64 varies. In this embodiment, the passage 64 is more inclined in the delay direction Y as it is apart from the center axis "O".

Figure 17A:
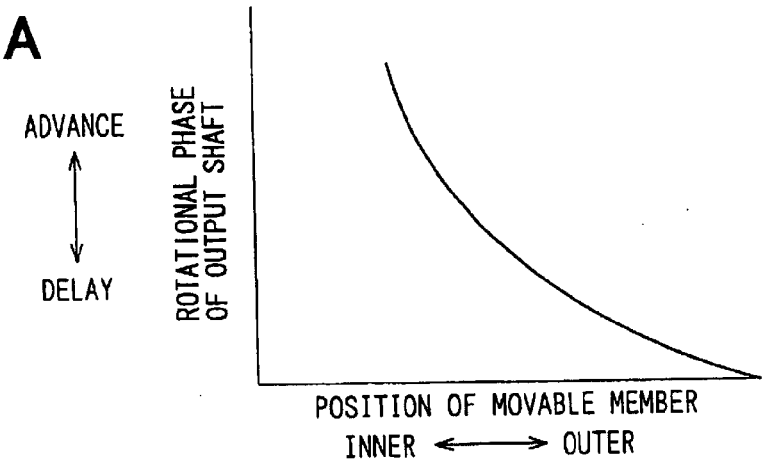
FIGS. 17A, 17B and 17C are graphs for showing a characteristic of the fifth embodiment.
Figure 17B:
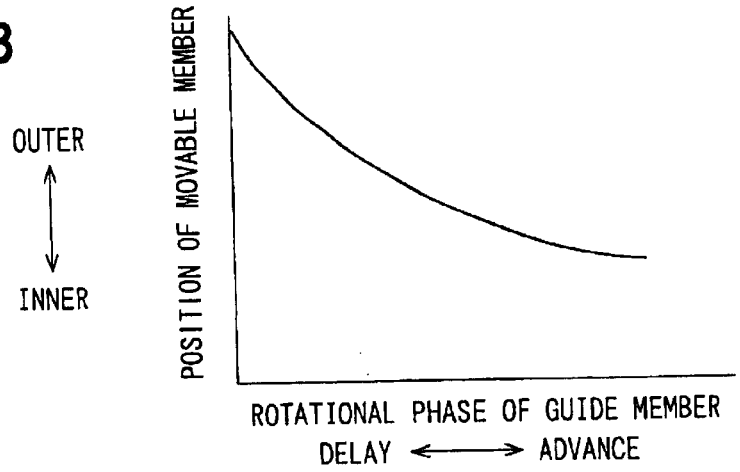
Figure 17C:
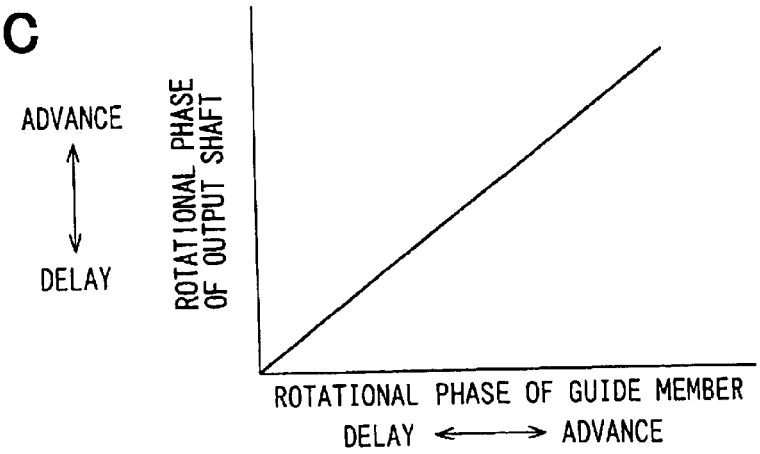

FIG. 17A shows a relationship between the radial distance of the movable member 26 and the rotational phase of the output shaft 16 relative to the sprocket 11. The radial distance of the movable member 26 represents the distance between the movable member 26 and the center axis "O". FIG. 17B shows the relationship between the rotational phase of the guide member 25 relative to the sprocket 11 and the radial distance of the movable member 26 from the center axis "O". The curvature of the guide passage 64 is formed to obtain the relationship shown in FIG. 17B. Thus, the rotational phase of the guide member 25 relative to the sprocket 11 is proportion to the rotational phase of the output shaft 16 relative to the sprocket 11 as shown in FIG. 17C. The movable member 26 slides the guide passage 64 relative to the guide member 25 and displaces the first arm 28 and the second arm 29, whereby the rotational phase of the output shaft 16 relative to the sprocket 11 can be varied in proportion to the rotational phase of the guide member 25. The reduction ratio between the guide member 25 and the output shaft 16 becomes constant and the precise control of the shaft phase is obtained.

Figure 18:
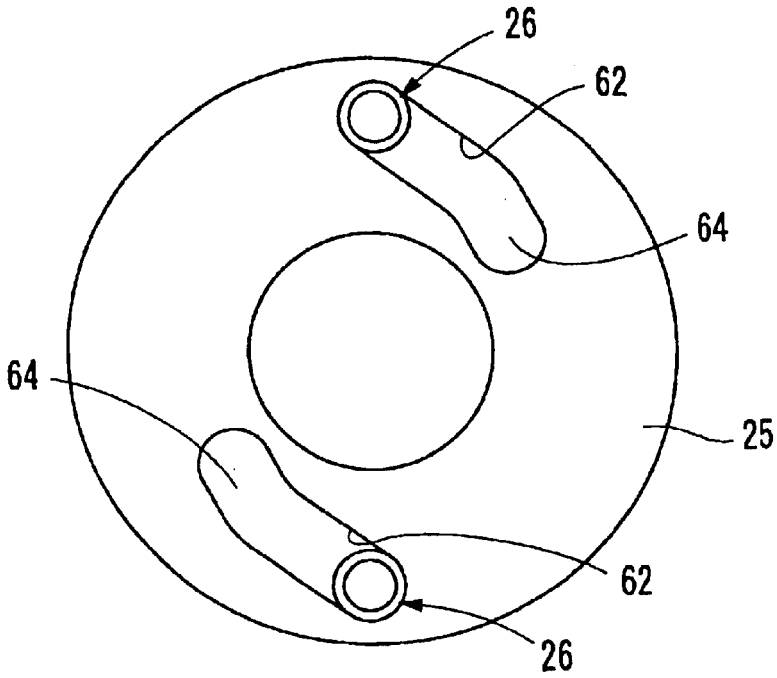
FIG. 18 is a schematic view according to a modification.

The shape of the guide passage 64 can be changed as shown in FIG. 18. The guide passage 64 is convex in the radial direction of the guide member 25.

In the first embodiment through the fifth embodiment, the guide member 25 rotates relative to the sprocket 11 and the movable member 26 slidablly moves in the guide passage 64 of the guide member 25. Alternatively, the guide member 25 moves linearly in the guide passage 64 of the guide member 25 relative to the phase adjusting mechanism 10.

The movable member 26 can be engaged with the first arm 28 and the second arm 29 at a position other than the end portions 28*d*, 29*d*.

Other type of the electric motor 30 can be used. A mechanism has a brake member which rotates with receiving a driving torque of the crankshaft and a solenoid which attracts the brake member. The brake torque generated by the brake member can be used as the control torque.

The reduction gears 20 can be replaced by the conventional reduction gears. Alternatively, the reduction gears 20 can be omitted and the control torque generated by the electric motor 30 can be transmitted to the guide member 25 directly.

What is claimed is:

1. A variable valve timing controller for an internal combustion engine, the variable valve timing controller being disposed in a system in which the torque of a driving shaft is transmitted to a driven shaft adjusting an opening and closing timing of an intake valve and/or an exhaust valves, comprising:

a phase adjusting mechanism having a first rotating member rotating in synchronizes with the driving shaft, a second rotating member rotating in synchronizes with the driven shaft, a first arm pivoting on the first rotating member, and a second arm pivoting on the second rotating member and the first arm; and a controller controlling a movement of at least one of the first arm and the second arm, wherein the phase adjusting mechanism varies a rotational phase of the driven shaft relative to the driving shaft by converting the movement of the arm controlled by the controller into the rotational movement of the second rotating member relative to the first rotating member.

2. The variable valve timing controller for an internal combustion engine according to claim 1, wherein at least one of a revolute pair of the first rotating member and the first arm, a revolute pair of the second rotating member and the second arm and a revolute pair of the first arm and the second arm is comprised of holes and a cylindrical pin, the holes being formed on the revolute pair and the cylindrical pin being rotationally engaged with the holes.

3. The variable valve timing controller for an internal combustion engine according to claim 1, wherein at least one of a revolute pair of the first rotating member and the first arm, a revolute pair of the second rotating member and the second arm and a revolute pair of the first arm and the second arm is comprised of a hole and a cylindrical pin, the hole being formed on half of the revolute pair and the cylindrical pin being formed on another half of the revolute pair.

4. The variable valve timing controller for an internal combustion engine according to claim 1, wherein a revolute pair of the second rotating member and the second arm, a revolute pair of the first rotating member and the first arm, and a revolute pair of the first arm and the second arm are arranged in this order or reverse order in a delay direction of the second rotating member relative to the first rotating member.

5. The variable valve timing controller for an internal combustion engine according to claim 1, wherein a revolute pair of the first rotating member and the first arm, a revolute pair of the second rotating member and the second arm, and a revolute pair of the first arm and the second arm are arranged in this order or reverse order in a delay direction of the second rotating member relative to the first rotating member.

6. The variable valve timing controller for an internal combustion engine according to claim 1, wherein a revolute pair of the first rotating member and the first arm, a revolute pair of the first arm and the second arm, and the second rotating member and the second arm are arranged in this order or reverse order in a delay direction of the second rotating member relative to the first rotating member.

7. The variable valve timing controller for an internal combustion engine according to claim 1, wherein the controller is provided with a movable member pivoted on the controlled arm, a guide member, and an actuator transmitting a controlled torque to the guide member, and the guide member is engaged with the movable member and introduces the movable member in a sliding direction with receiving a control torque.

8. The variable valve timing controller for an internal combustion engine according to claim 7, wherein the actuator includes an electric motor generating a control torque.

9. The variable valve timing controller for an internal combustion engine according to claim 7, wherein the guide member includes a guide passage which inclines relative to the radial direction in such a manner that a radial distance between the guide member and a center axis varies in circumferential direction, and the movable member slides in the guide passage relative to the guide member.

10. The variable valve timing controller for an internal combustion engine according to claim 9, wherein the movable member slides in the guide passage and moves the controlled arm whereby a rotational phase of the second rotational member relative to the first rotating member varies in proportion to rotational phase of the guide member relative to the first rotating member.

* * * * *